US005707019A

United States Patent [19]

Aikawa

[11] Patent Number: 5,707,019

[45] Date of Patent: Jan. 13, 1998

[54] REFINER WITH EASILY ATTACHABLE DISCS

[75] Inventor: Yoshihiko Aikawa, Shizuoka, Japan

[73] Assignee: Aikawa Iron Works Co., Ltd., Shizuoka, Japan

[21] Appl. No.: 610,192

[22] Filed: Mar. 4, 1996

[51] Int. Cl.[6] ..... B02C 7/12

[52] U.S. Cl. ..... 241/261.2; 241/297; 241/298

[58] Field of Search ..... 241/296, 297, 241/298, 261.2, 261.3

[56] References Cited

U.S. PATENT DOCUMENTS

| | | | |
|---|---|---|---|
| 93,913 | 8/1869 | Shaw | 241/298 |
| 3,326,480 | 6/1967 | Jones | 241/298 |
| 4,005,827 | 2/1977 | Frair et al. | 241/298 X |
| 4,036,443 | 7/1977 | Saltarelli | 241/298 X |
| 4,234,602 | 6/1981 | Johansson | 241/298 |
| 5,449,122 | 9/1995 | Berger et al. | 241/298 X |

*Primary Examiner*—Mark Rosenbaum

*Attorney, Agent, or Firm*—Kanesaka & Takeuchi

[57] ABSTRACT

A refiner is formed of a plurality of first disc members provided on a casing and divided along a circumferential direction thereof; a plurality of first connecting members for fixing the first disc members to the casing; a plurality of second disc members provided on a runner with a rotating shaft, the second disc members facing the first disc members and divided along a circumferential direction thereof; and a plurality of second connecting members for fixing the second disc members to the runner. The refiner also includes engaging members provided on outer peripheral surfaces except for blade faces of the first disc members or the second disc members; and engaged members provided on at least one of the casing or the runner. When the rotating shaft is rotated, loads applied to the first connecting members or the second connecting members can be reduced greatly.

8 Claims, 12 Drawing Sheets

REFINER WITH EASILY ATTACHABLE DISCS

BACKGROUND OF THE INVENTION AND RELATED ART STATEMENT

The invention relates to a refiner or grinder to be used for crushing or grinding, for example, a fiber material.

FIG. 12 is a front sectional view for showing a conventional refiner or grinder A. A casing 100 is provided with a first supply port 101, and in an inner portion of the casing 100, a movable block 103 having a second supply port 102 is formed.

A crushing chamber B defined by the casing 100 and the movable block 103 is communicated with the first supply port 101, the second supply port 102 and a discharge port 104.

The casing 100 and the movable block 103 are respectively provided, at the surfaces facing each other, with a plurality of first discs 106, 105 divided along the circumferential directions thereof. The first discs 105, 106 are provided, at the side surfaces thereof, with blade faces 105A, 106A, respectively.

A rotating shaft 111 is inserted into inner portions of the first discs 105, 106, and is provided with a circular plate-shape runner 107 facing the first discs 105, 106. The runner 107 is provided, at positions facing the blade faces 105A, 106A, with a plurality of second discs 109, 110 divided along circumferential directions thereof.

The plural second discs 109, 110 are provided, at the sides facing the blade faces 105A, 106A, with blade faces 109A, 110A, respectively. Fine spaces of several micro meters are formed between the blade faces 105A and 109A and between the blade faces 106A and 110A, respectively.

FIG. 13 is a perspective view showing a fixing mechanism of the second discs 109. The runner 107 is provided, at a side surface thereof, with a plurality of female threads 112 along a circumferential direction thereof, and the plural second discs 109 are provided with holes 113 penetrating therethrough in a direction of an axis C of the rotating shaft 111.

Screw members 108 are inserted into the holes 113, and the plural second discs 109 are fixed to the runner 107 by tightening the screw members 108.

Also, the runner 107 is provided, at an outer periphery thereof, with an annular rib 115 projecting in a direction of the axis C to position the second discs 109 in the radial directions.

The second discs 110 are also fixed to the runner 107 as in the second discs 109. Also, the first discs 105, 106 are fixed with the same mechanism as in the second discs 109, 110.

The reason why the first discs 105, 106 and the second discs 109, 110 are respectively divided in the circumferential directions thereof is that the discs can be easily attached to or detached from the casing 100 and runner 107 with the reduction of weight of the respective discs.

Two bearings 116, 117 provided at side portions of the casing 100 hold the rotating shaft 111, and one end of the rotating shaft 111 is connected to a driving source, not shown.

In the above structure, the rotating shaft 111 is rotated and at the same time a material, such as a fiber material, not shown, is supplied to the crushing chamber B through the first supply port 101 and the second supply port 102.

While being crushed or ground between the blade faces 105A and 109A and between the blade faces 106A and 110A, the material is moved outwardly by a centrifugal force and is discharged through the discharge port 104.

In the above conventional example, when the rotating shaft 111 is rotated, due to frictional resistance of the first discs 105, 106 with the material, a load in the circumferential direction is applied to the first discs 105, 106, so that whole load is applied to the screw members. On the other hand, a load in the radial direction is applied to the second discs 109, 110, and the whole load due to an inertial force is applied to, for example, connecting members, i.e. screw members 108.

Therefore, a large number of screw members are used, or the screw members are made thicker.

As a result, effective areas of the blade faces 109A, 110A are reduced for 7 to 10%, so that the crushing efficiency is lowered, or tightening and loosening operations of the screw members 108 are increased for changing the discs to thereby cause trouble in attaching and detaching operations of the second discs 109, 110.

Incidentally, the above described problems take place not only in the case where the second discs 109, 110 or the first discs 105, 106 are combined together, but also in a case where integrally formed discs are attached to the runner or the casing by the connecting members.

Accordingly, one object of the invention is to provide a refiner, wherein load applied to the disc members at a time of rotation of a rotating shaft is reduced as much as possible.

Another object of the invention is to provide a refiner as stated above, wherein crushing efficiency of a material can be improved.

A further object of the invention is to provide a refiner as stated above, wherein attaching and detaching operations of the plural discs can be simplified.

A still further object of the invention is to provide a refiner as stated above, wherein at a time of attaching of the discs, the discs can be quickly positioned.

Further objects and advantages of the invention will be apparent from the following description of the invention.

SUMMARY OF THE INVENTION

In order to attain the above stated objects, a refiner or grinder according to a first aspect of the invention comprises a plurality of first disc members provided on a casing and divided along a circumferential direction thereof; first connecting members for fixing the first disc members by penetrating therethrough from a blade face to a thickness direction thereof; a plurality of second disc members provided on a runner with a rotating shaft to face the first disc members and divided along a circumferential direction thereof; and second connecting members for fixing the second disc members by penetrating therethrough from a blade face to a thickness direction thereof. The refiner further includes engaging members provided to outer peripheries, except for blade faces, of at least one of the first disc members and the second disc members, and engaged members engaging the engaging members provided on at least one of the casing and the runner.

In a second aspect of the invention, the refiner has the structure as in the first aspect, wherein the first disc members and the second disc members have fan-shapes, and the engaging members are formed on the outer circumferential arc shape peripheries of at least one of the first and second disc members.

A method for attaching discs of a refiner according to a third aspect of the invention comprises: a first step of positioning a plurality of first disc members or a plurality of second disc members in a circumferential direction by interlocking engaging members provided on the outer peripheries, except for blade faces, of the first disc members and/or the second disc members, with engaged members provided on at least one of a casing or a runner with a rotating shaft; a second step of fixing the first disc members to the casing by first connecting members penetrating through the first disc members from a blade face; and a third step of fixing the second disc members to the runner by second connecting members penetrating through the plural second disc members from a blade face.

Also, a refiner according to a fourth aspect of the invention comprises discs having blades; a circular plate-shape runner provided with the discs; and a rotating shaft fixed to the circular plate-shape runner. The refiner further includes engaging members provided on the outer peripheries of the discs; at least one annular rib projecting from the outer periphery of the runner in an axial direction of the rotating shaft to form a disc receiving dent portion for receiving the discs therein; and engaging-member receiving dent portions to be engaged with the engaging members and provided in the annular rib. Each engaging-member receiving dent portion opens at least to a surface facing the axial direction of the rotating shaft and a surface facing a radially inner direction of the circular plate-shape runner. Each dent portion has a bottom surface, a first vertical surface and a second vertical surface, wherein both vertical surfaces vertically extend from the bottom surface to face each other, and are formed in a direction crossing the rib. The first vertical surface faces a rotating direction of the circular plate-shape runner, while the second vertical surface faces an opposite direction to the rotating direction of the circular plate-shape runner. The discs are attached to the circular plate-shape runner by connecting members at least in a state that the engaging members are in surface contact with the first vertical surfaces.

A refiner according to a fifth aspect of the invention includes the structure as in the fourth aspect, wherein the second vertical surface is inclined such that a space between the first and second vertical surfaces is narrower on a far side than a near side from a center of the circular plate-shape runner. Also, the disc is attached to the circular plate-shape runner by the connecting members under a condition that the engaging member is in surface contact with the first vertical surface while an edge of the engaging member abuts against the second vertical surface.

Also, in a refiner according to a sixth aspect of the invention, the discs in the fourth and fifth aspects are divided.

In the first aspect of the invention, at the time of rotation of the rotating shaft, the loads of at least the first disc members or the second disc members are dispersed to the connecting members, the engaging members and the engaged members.

In the second aspect of the invention, in addition to the effect of the first aspect of the invention, since the engaging members are disposed outside the first disc members or the second disc members, the engaging members can be visually identified.

In the third aspect of the invention, at the time of rotation of the rotating shaft, loads applied to at least the first disc members or the second disc members are dispersed to the connecting members, the engaging members and the engaged members.

In the fourth aspect of the invention, in a state that the engaging members are in surface contact with the first vertical surfaces, the discs are attached to the circular plate-shape runner through the connecting members.

In the fifth aspect of the invention, in a state that the engaging members are in surface contact with the first vertical surfaces and edges of the engaging members abut against the second vertical surfaces, the discs are attached to the circular plate-shape runner by the connecting members.

DETAILED DESCRIPTION OF PREFERRED EMBODIMENTS

Figure 1:
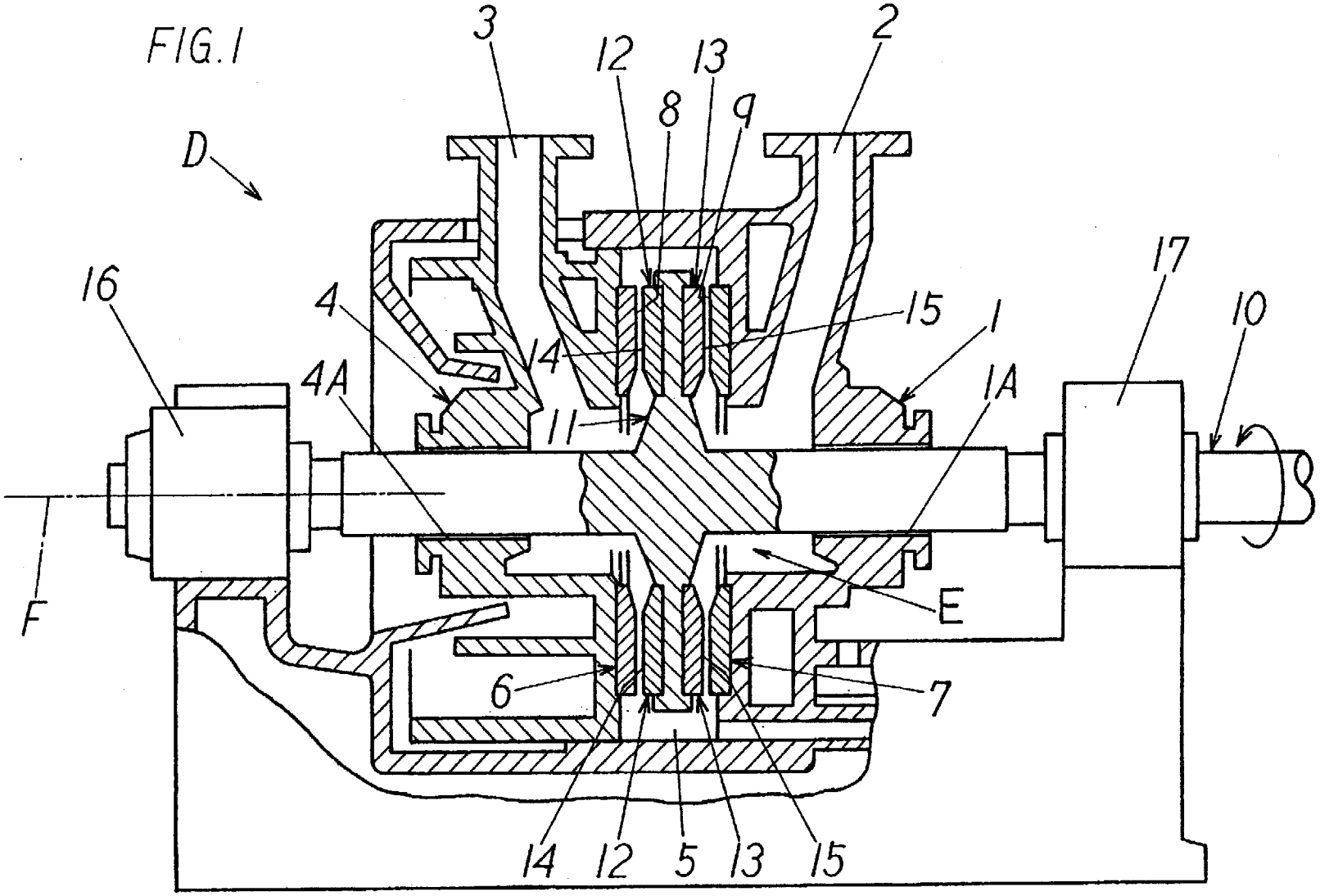
FIG. 1 is a front sectional view for showing a refiner of an embodiment according to the present invention.

FIG. 1 is a front sectional view for showing a refiner D of an embodiment according to the present invention. A casing 1 is provided, at an upper portion thereof, with a first supply port 2 along a vertical direction thereof and, at a lower portion of the first supply port 2, with a shaft hole 1A extending approximately along a horizontal direction. Also, the casing 1 is provided, at an inner portion thereof, with a movable block 4 having a second supply port 3.

The movable block 4 is provided with a shaft hole 4A extending generally along a horizontal direction. The shaft hole 4A and the shaft hole 1A are set to the same diameters, and are disposed concentrically. Also, the movable block 4 can be reciprocated substantially in the horizontal direction by an operation portion, such as an oil pressure cylinder, not shown.

A crushing chamber E is defined by the casing 1 and the movable block 4 and communicates, at about a center thereof, with the first supply port 2 and the second supply port 3. The crushing chamber E communicates with a discharge port 5 at a lower portion thereof.

At the facing surfaces of the casing 1 and the movable block 4, there is provided a plurality of fan-shaped first disc members 6, 7 made of metal and divided along their circumferential directions, respectively. The first disc members 6, 7 are disposed concentrically with the shaft holes 1A, 4A, respectively, and are provided with blade faces 8, 9 at the side faces thereof. Incidentally, the divided first disc members 6, or the first disc members 7, constitute a first disc by combining them in a circular shape.

A rotating shaft 10 is inserted into the inner sides of the first disc members 6, 7 and the shaft holes 1A, 4A, and is provided with a circular plate-shape runner 11 at a position constituting the crushing chamber E. The runner 11 may be integrally formed with the rotating shaft 10, or may be formed separately and fixed to the rotating shaft 10.

The rotating shaft 10 is movably situated along an axis F in about a horizontal direction, and held by two bearings 16, 17 provided at outer portions of the casing 1. The shaft 10 is rotated by a driving source, not shown.

The runner 11 is positioned between the first disc members 6, 7, and is provided, on both sides thereof, with a plurality of second disc members 12, 13 made of metal, divided along the circumferential direction and having a fan shape, respectively. Incidentally, by combining the divided plural second disc members 12, or the divided plural second disc members 13, in a circular plate shape, the second discs are formed.

The respective second disc members 12, 13 are provided with blade faces 14, 15 at side surfaces facing the blade faces 8, 9. Fine spaces of several micro meters are set between the blade faces 8 and 14 and between the blade faces 9 and 15, respectively.

The fine spaces can be adjusted by moving the rotating shaft 10 and the movable block 4 according to conditions, such as a type of materials.

Figure 2:
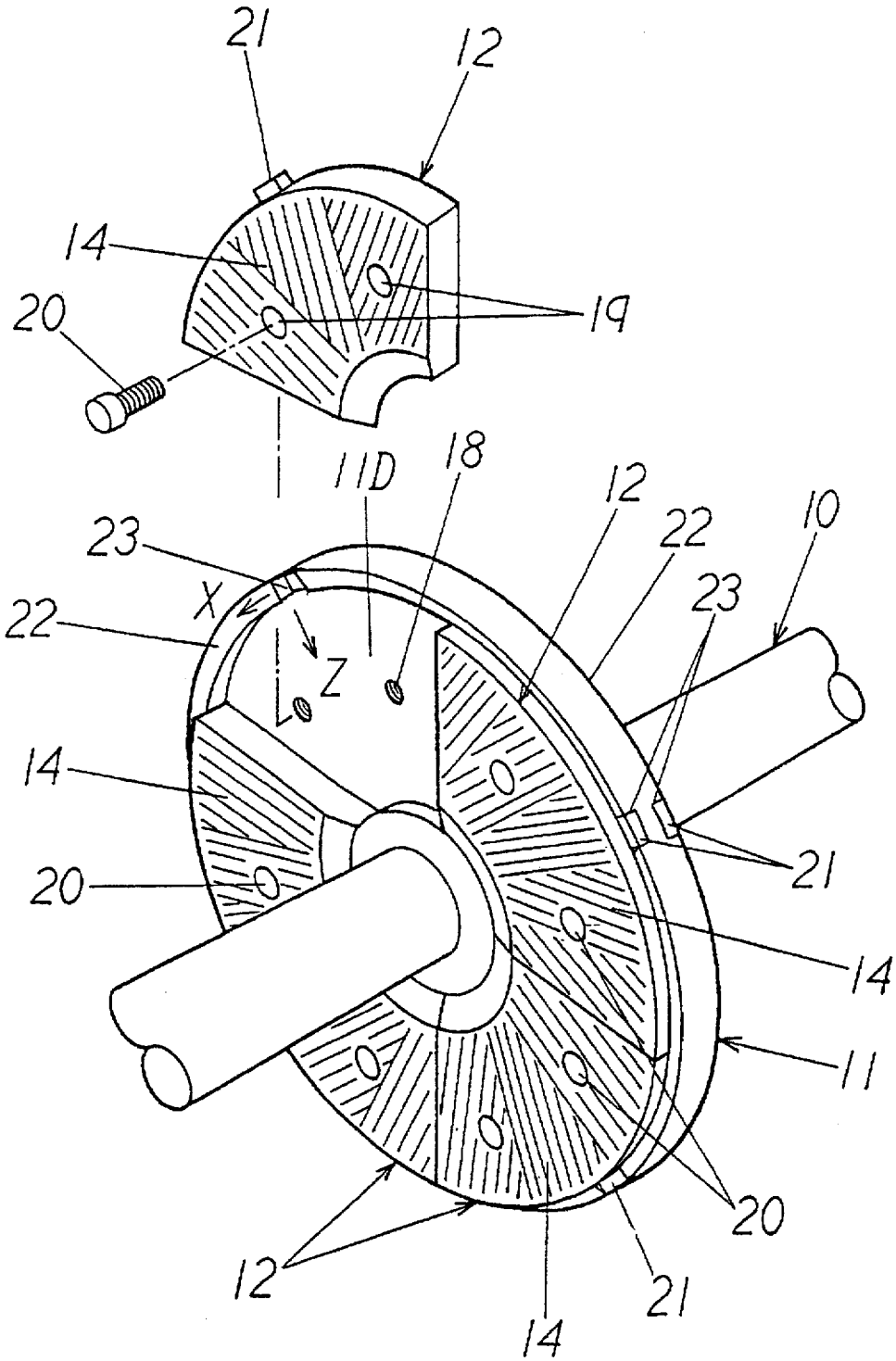
FIG. 2 is a perspective view for showing a runner of a refiner and second discs of the embodiment according to the present invention.

FIG. 2 is a perspective view for showing a structure of the second disc members 12 and the runner 11, wherein the second disc members 12 are, for example, divided into four equal portions with 90 degrees. The second disc member 12 is provided, on an outer circular arc thereof, with an engaging member, i.e. engaging pawl 21 projecting in a radial direction.

The runner 11 is, at the side surfaces thereof, provided with a plurality of female threads 18 along the circumferential direction thereof, and the respective second disc members 12 are provided with a plurality of through holes 19 in the thickness direction thereof, i.e. in the direction of the axis F of the rotating shaft 10.

Connecting members, i.e. bolts 20, are inserted into the respective holes 19, and the bolts 20 are screwed into the female threads 18 and tightened, so that the second disc members 12 are fixed to the runner 11, respectively.

Also, the runner 11 is provided at an outer periphery thereof with an annular rib 22 projecting in the direction of the axis F, and the rib 22 is provided with a plurality of engaging members, i.e. engaging grooves 23.

Incidentally, a structure and a mechanism of the second disc members 13 fixed to the runner are the same as those of the second disc members 12. Also, the first disc members 6, 7 are respectively provided with through holes in the direction of the thickness thereof, and fixed to the casing 1 and the movable block 4 by second connecting members, i.e. bolts, passing through the through holes.

In the structure as described above, when the rotating shaft 10 is rotated and at the same time the crushing chamber B is supplied with a material, such as a fiber material, not shown, through the first supply port 2 and the second supply port 3, the fiber material is moved toward an outer peripheral side by a centrifugal force while being crushed and ground between the blade faces 8, 14 and between the blade faces 9, 15, and is discharged through the discharge port 5.

During rotation of the rotating shaft 10, loads due to the centrifugal force of the second disc members 12, 13 are received by the bolts 20 and the ribs 22.

Also, since the second disc members 12 are positioned on the runner 11 along the circumferential direction thereof through the engagement of the engaging pawls 21 and the engaging grooves 23, and are fixed thereto by the bolts 20 in the thickness and radial directions, loads created by the inertial forces of the second disc members 12 at the time of rotation of the runner 11 are spread to the bolts 20, engaging pawls 21 and the engaging grooves 23 and are supported thereat.

Therefore, the number of the bolts 20 provided to each second disc member 12 may be decreased, and/or the bolts 20 may be made thinner, so that the effective areas of the blade faces 14, 15 can be increased. If the effective areas are created as much as possible, the reduction of the effective areas is about 3% of the whole areas. Therefore, crushing or grinding efficiency of the fiber material can be improved, and at the same time the tightening and loosening operations of the bolts 20 are decreased, so that attaching and detaching operations of the second disc members 12, 13 can be simplified.

Further, since the second disc members 12, 13 are, at the outer peripheries thereof, provided with the engaging pawls 21, and the runner 11 is, at the outer periphery thereof, provided with the engaging grooves 23, at the time of attaching of the second disc members 12, 13, the engaging pawls 21 and the engaging grooves 23 can be visually identified. Thus, the second disc members 12, 13 can be quickly positioned.

Incidentally, the first disc members 6, 7, the casing 1 and the movable block 4 may be provided with the same engaging pawls and engaging grooves as described above, respectively. When the engaging pawls and the engaging grooves are formed, loads applied to the first disc members 6, 7 created by friction resistance with the fiber material at the time of rotation of the rotating shaft 10 are dispersed to the bolts, the engaging pawls and the engaging grooves. Therefore, the same effect as stated above can be obtained.

The first discs 6, 7 and the second discs 12, 13 of the present embodiment are fixed by the following three steps:

a first step wherein the engaging members provided on the first disc members 6, 7 and the second disc members 12, 13 are engaged on the casing 1 and the runner 11, so that the first disc members 6, 7 and the second disc members 12, 13 are positioned in the circumferential direction to face with each other;

a second step wherein the first disc members 6, 7 are fixed to the casing 1 by the first connecting members penetrating through the first disc members 6, 7 from the blade surface;

a third step wherein the second disc members 12, 13 are fixed to the runner 11 by the second connecting members penetrating through the second disc members 12, 13 from the blade surface.

Incidentally, the order of the second step and the third step may be reversed.

Also, in the present embodiment, although two sets of the first disc members and two sets of the second disc members are provided, the present invention can be also applied to a refiner formed of a single set of the first disc members and a single set of the second disc members.

Also, the engaging member may be, for example, an engaging groove, and the engaged member may be, for example, an engaging pawl. And, a plurality of second disc members may be positioned in a circumferential direction through engagement of the engaging grooves and the engaging pawls. In this arrangement, the same effect as mentioned above can be obtained.

Also, in case the engaging members and the engaged members are provided on mutually facing side surfaces of the second disc members and the holding members, the same effect as mentioned above can be obtained.

Also, as the connecting members, for example, stud bolts may be provided on side surfaces of holding members for supporting the disc members. The stud bolts may be entered into holes of the second disc members, and tightened by nuts.

Also, the second disc members may be divided to any desired number, and the refiner provided with the second disc members may be used for crushing or grinding other materials, such as dung, garbages, coffee beans or the like.

Figure 3:
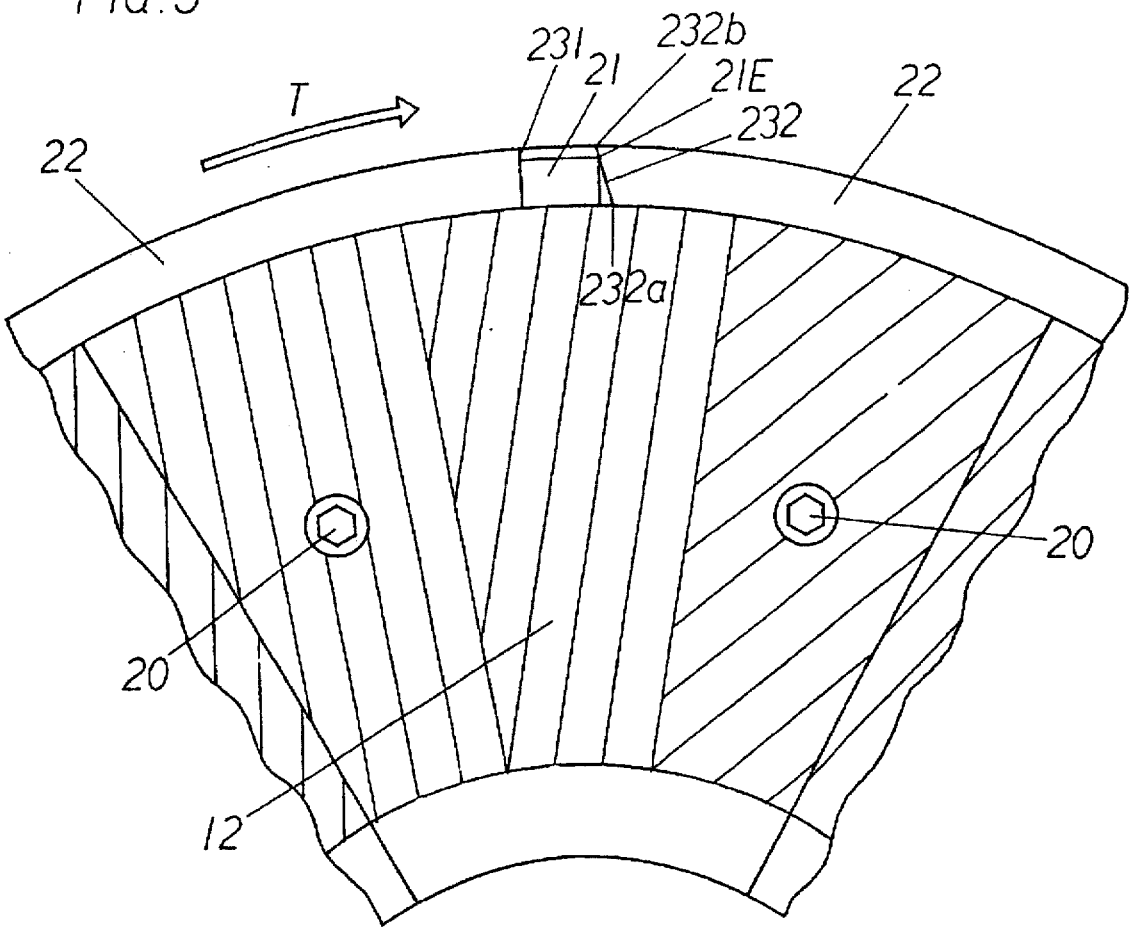
FIG. 3 is an enlarged explanatory view for showing an engaging member of a disc and an engaged member provided to a rib of the runner which are essential parts of the invention.
Figure 7:
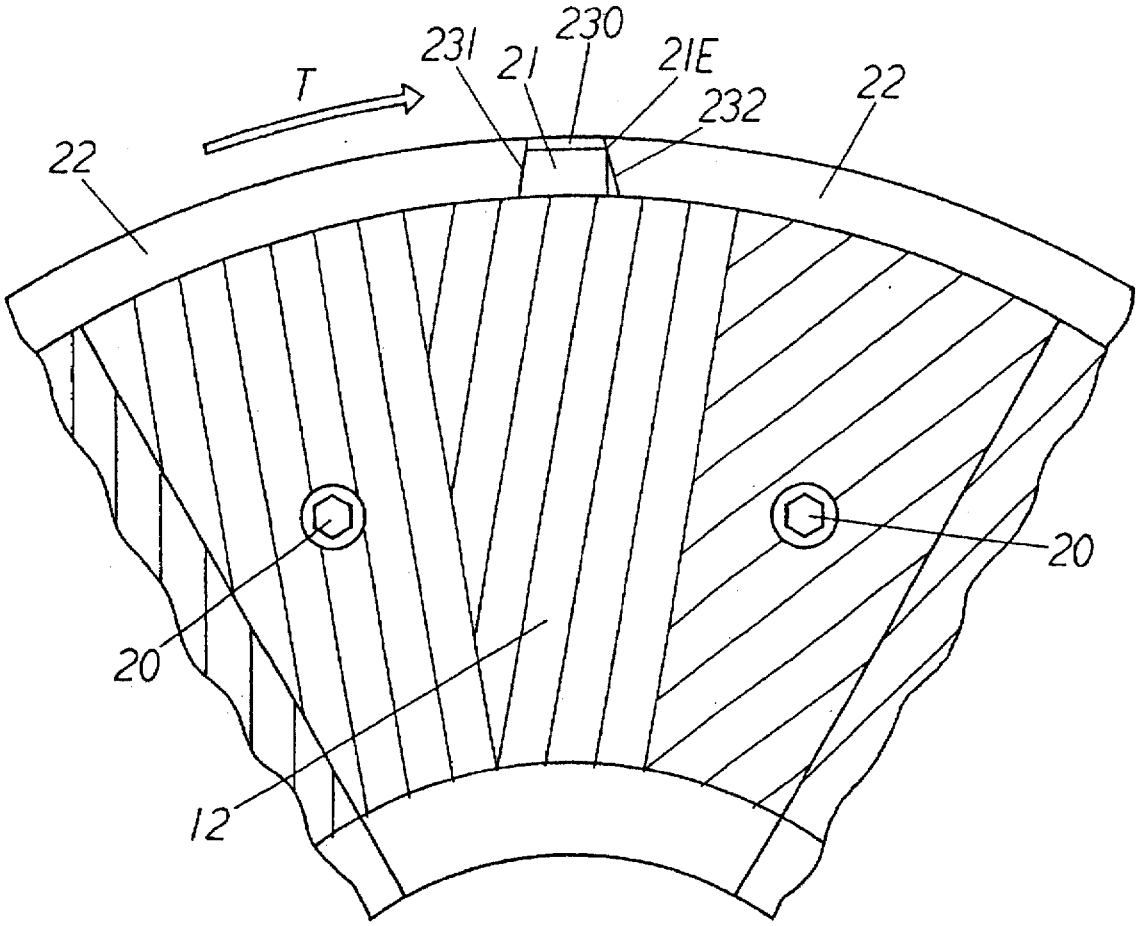
FIG. 7 is an explanatory view for explaining another embodiment relative to the embodiment as shown in FIG. 3.
Figure 8:
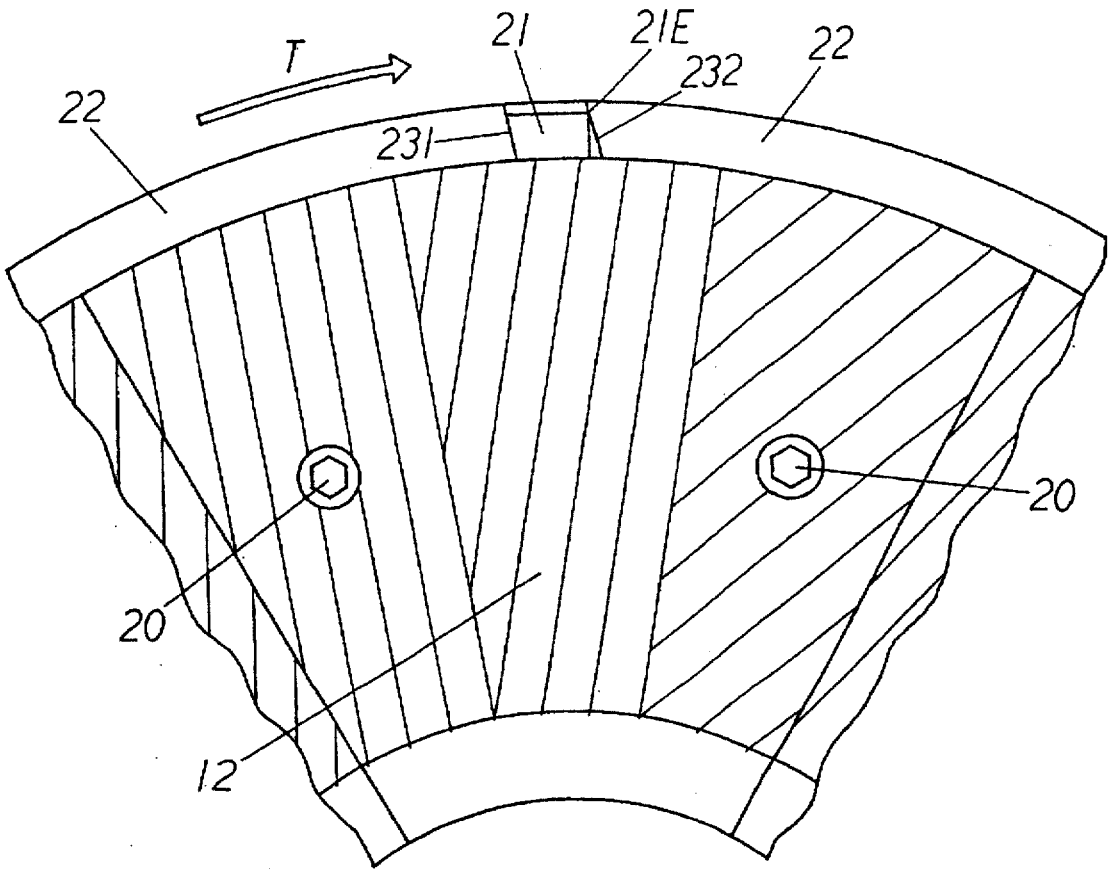
FIG. 8 is an explanatory view for explaining another embodiment relative to the embodiment as shown in FIG. 7.

Incidentally, especially, as shown in FIGS. 3, 7 and 8, the engaging member, i.e. the engaging pawl 21 projecting to a diametral direction, which is engaged with the engaged member, i.e. the engaging groove 23, has a face-to-face contact with a first vertical surface 231, and an edge 21E of the engaging member abuts against a second vertical surface 232. In this condition, the discs, i.e. the second disc members 12, 13, are preferably attached to the circular plate-shape runner 11 through the connecting members, i.e. the bolts 20.

Accordingly, in case the circular plate-shape runner 11 is rotated and the loads are applied to the discs, i.e. the second discs 12, 13, since the engaging members, i.e. the engaging pawls 21 projecting to the radial direction, are in surface contact with the first vertical surfaces 231, the forces are positively applied to the engaging members, i.e. the engaging pawls 21 projecting to the diametral direction.

On the one hand, although a centrifugal force acts in accordance with rotation of the runner 11, since the edge 21E of the engaging member, i.e. the pawl 21 projecting to the diametral direction, abuts against the second vertical surface 232, the force is dispersed by the abutment. Therefore, the force acted on the connecting members can be reduced.

More specifically, in the present invention, the refiner or grinder comprises discs, i.e. the plural second disc members 12, 13, having the blades, the circular plate-shape runner 11 provided with the second disc members 12, 13, and the rotating shaft 10 provided with the circular plate-shape runner 11. The refiner further includes: engaging members, i.e. the engaging pawls 21 projecting to a radial direction, provided on the outer peripheral surfaces of the second disc members 12, 13; annular ribs 22 projecting toward an axial direction of the rotating shaft 10 from the outer peripheral surface of the runner 11 to form the disc receiving dents 11D for receiving the second disc members 12, 13; and engaging member receiving dent portions, i.e. the engaging grooves 23, formed in the annular ribs 22. The dent portions engage the engaging members, i.e. the engaging pawls 21 projecting to the diametral direction.

Figure 4:
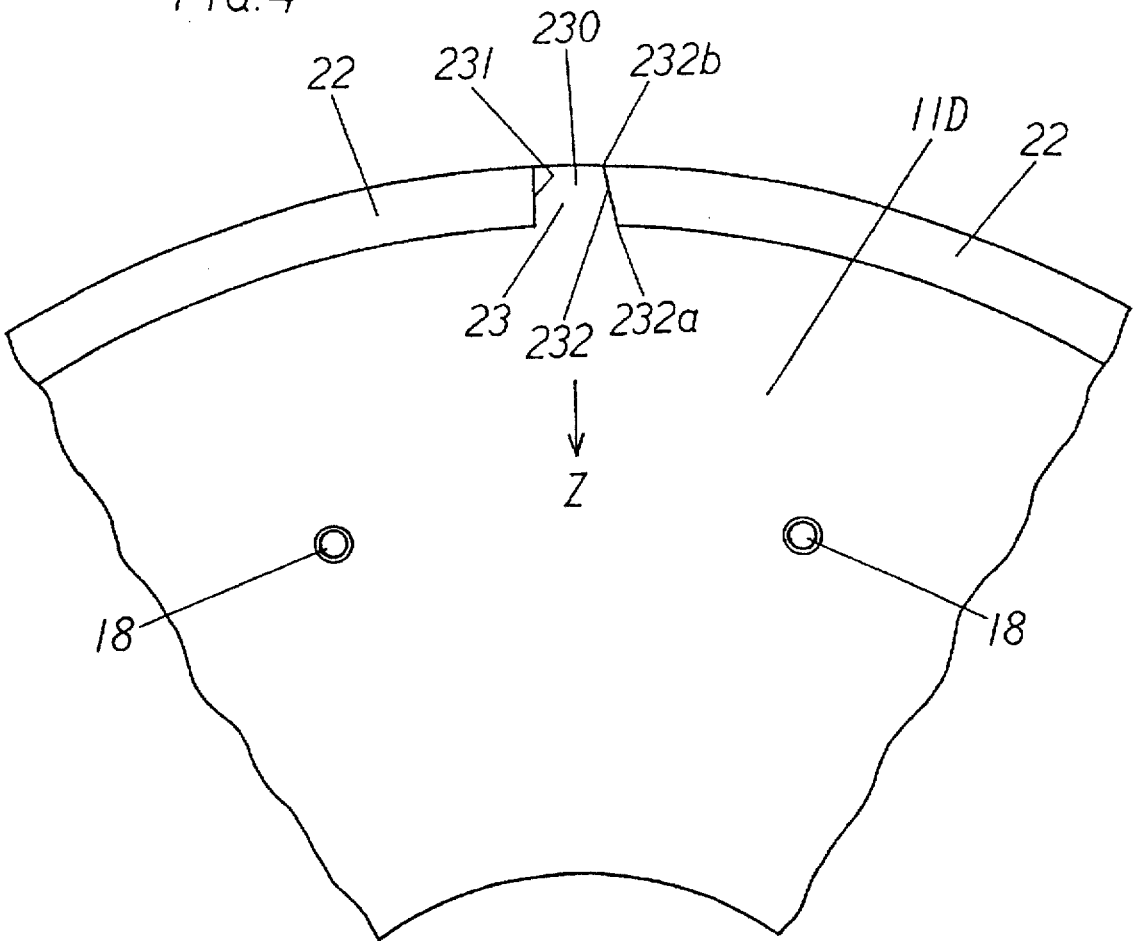
FIG. 4 is an explanatory view for showing the runner before a disc is provided.
Figure 5:
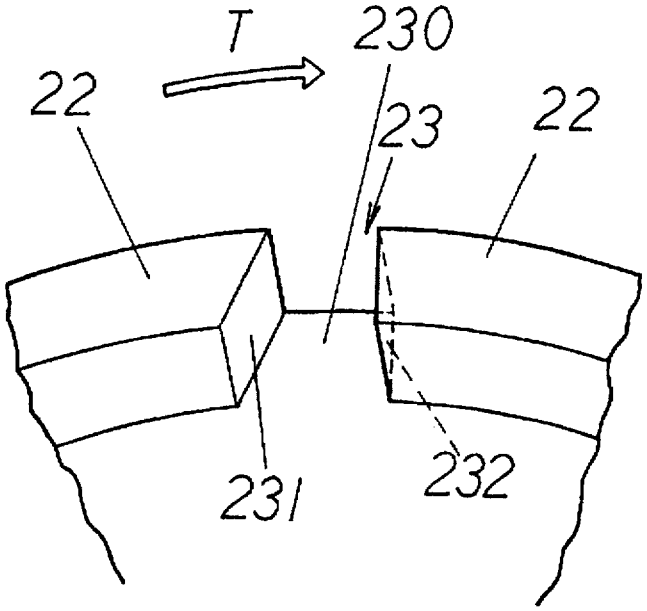
FIG. 5 is a perspective view for showing an engaging member receiving dent portion.
Figure 6:
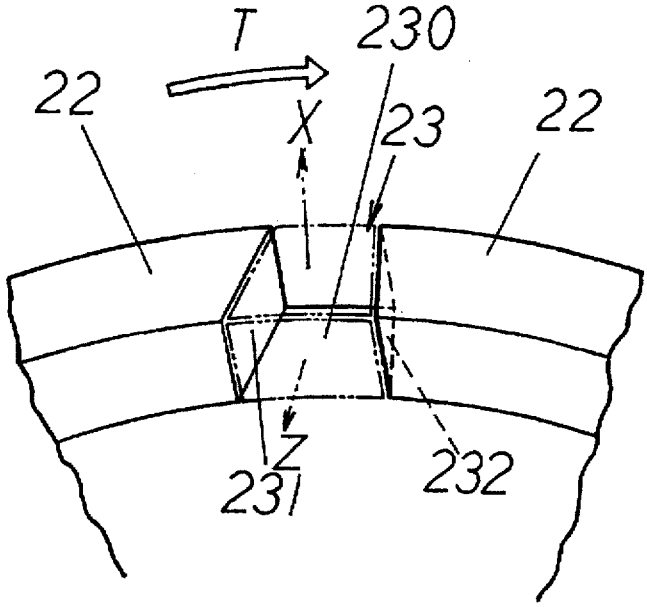
FIG. 6 is an explanatory view for explaining opening portions of the engaging member receiving dent portion.

Each engaging member receiving dent portion, i.e. the engaging groove 23, opens at least to a surface facing the circumferential direction, i.e. an X direction in FIGS. 2 and 6, of the rotating shaft 10, and to a surface facing a radially inner direction, i.e. in a Z direction in FIGS. 2, 4 and 6, of the circular plate-shape runner 11. The engaging member receiving dent portion has a bottom surface 230, and first and second vertical surfaces 231, 232 vertically arranged to the bottom surface 230 in a direction crossing the rib 22 and facing each other. The first vertical surface 231 faces a rotating direction, i.e. T direction in FIG. 3, of the circular plate-shape runner 11, and the second vertical surface 232 faces a direction opposite to the rotating direction, i.e. T direction in FIG. 3, of the circular plate-shape runner 11. The second vertical surface 232 is formed with an inclination to be narrower relative to the first vertical surface 231 on a far side, i.e. **232*b* in FIGS. 3 and 4, than on a near side, i.e. 232*a* in FIGS. 3 and 4, from the center of the circular plate-shape runner 11**.

Each engaging member, i.e. the engaging pawl 21 projecting to the radial direction, has a surface contacting the first vertical surface 231, and an edge 21E of the engaging member, i.e. the engaging pawl 21 projecting to the radial direction, abuts against the second vertical surface 232. In this condition, the discs, i.e. the second disc members 12, 13, are attached to the circular plate-shape runner 11 by the connecting members, i.e. bolts 20.

Figure 9:
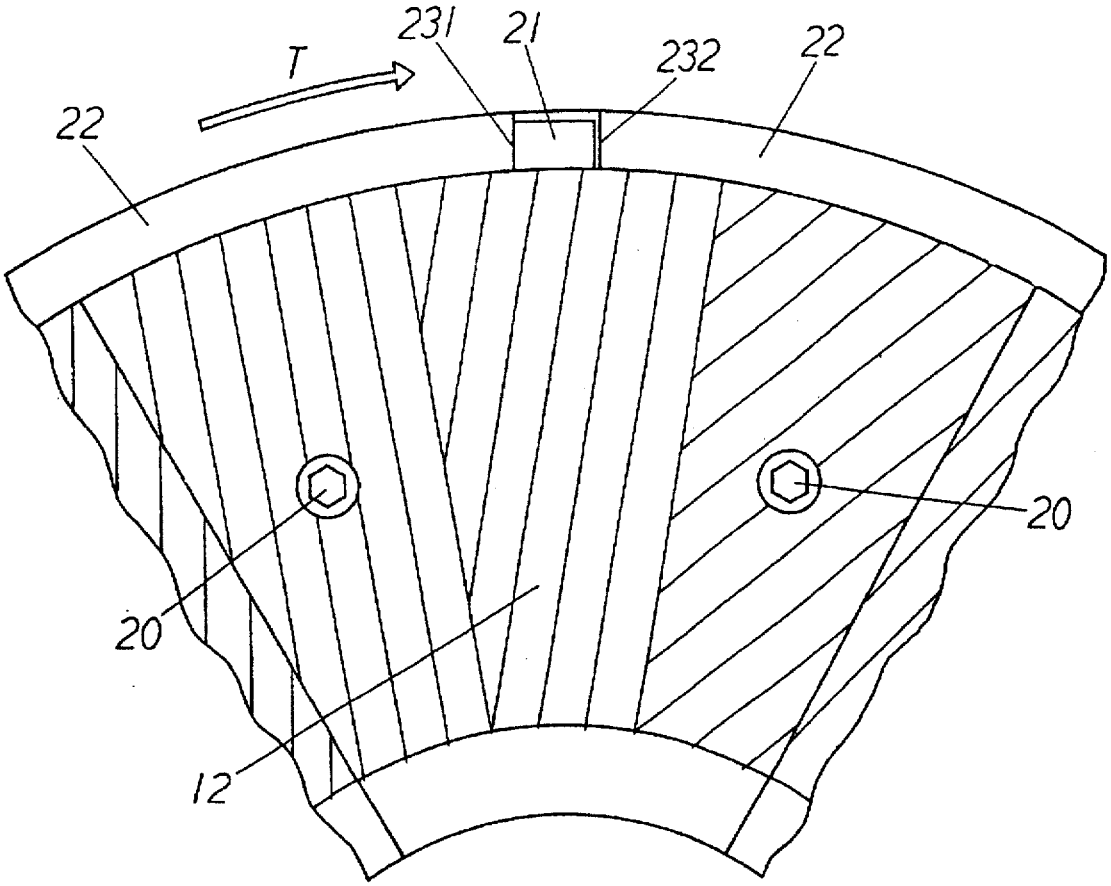
FIG. 9 is an explanatory view for explaining another embodiment relative to the embodiment as shown in FIG. 8.
Figure 10:
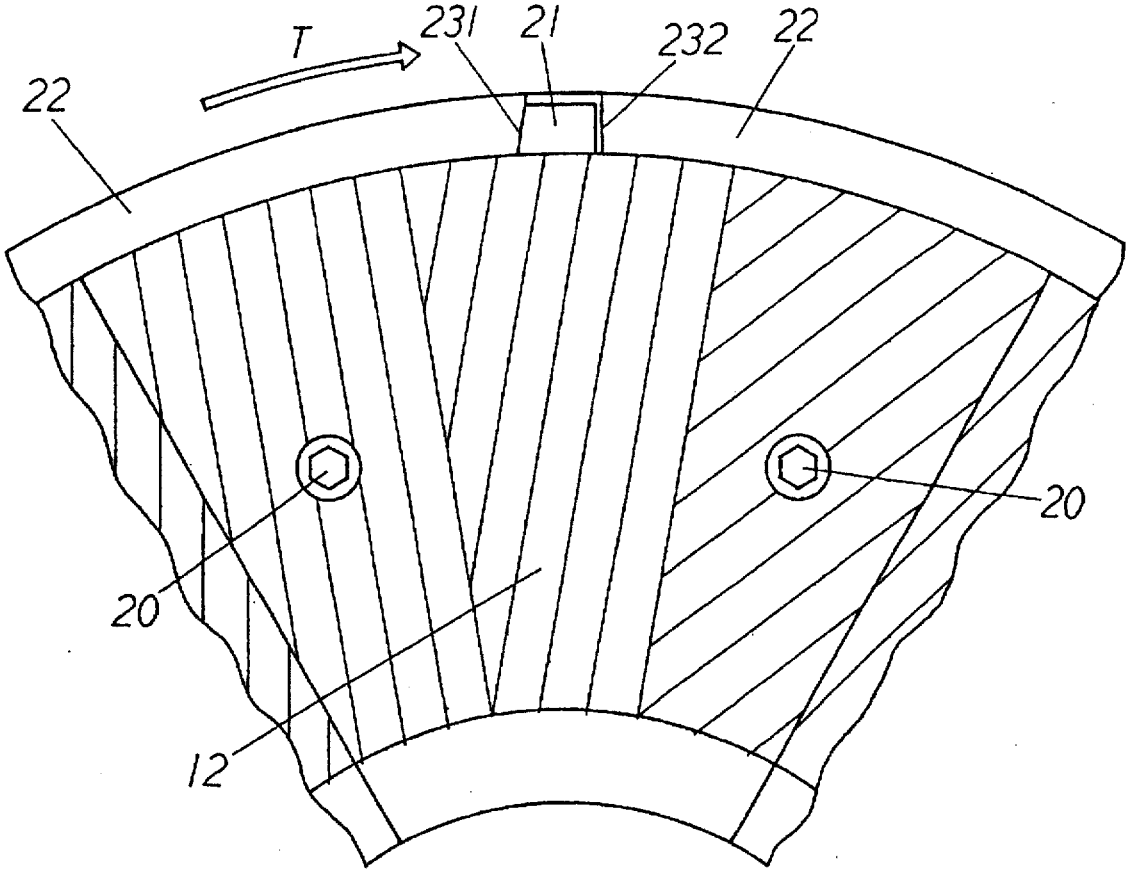
FIG. 10 is an explanatory view for explaining another embodiment relative to the embodiment as shown in FIG. 9.
Figure 11:
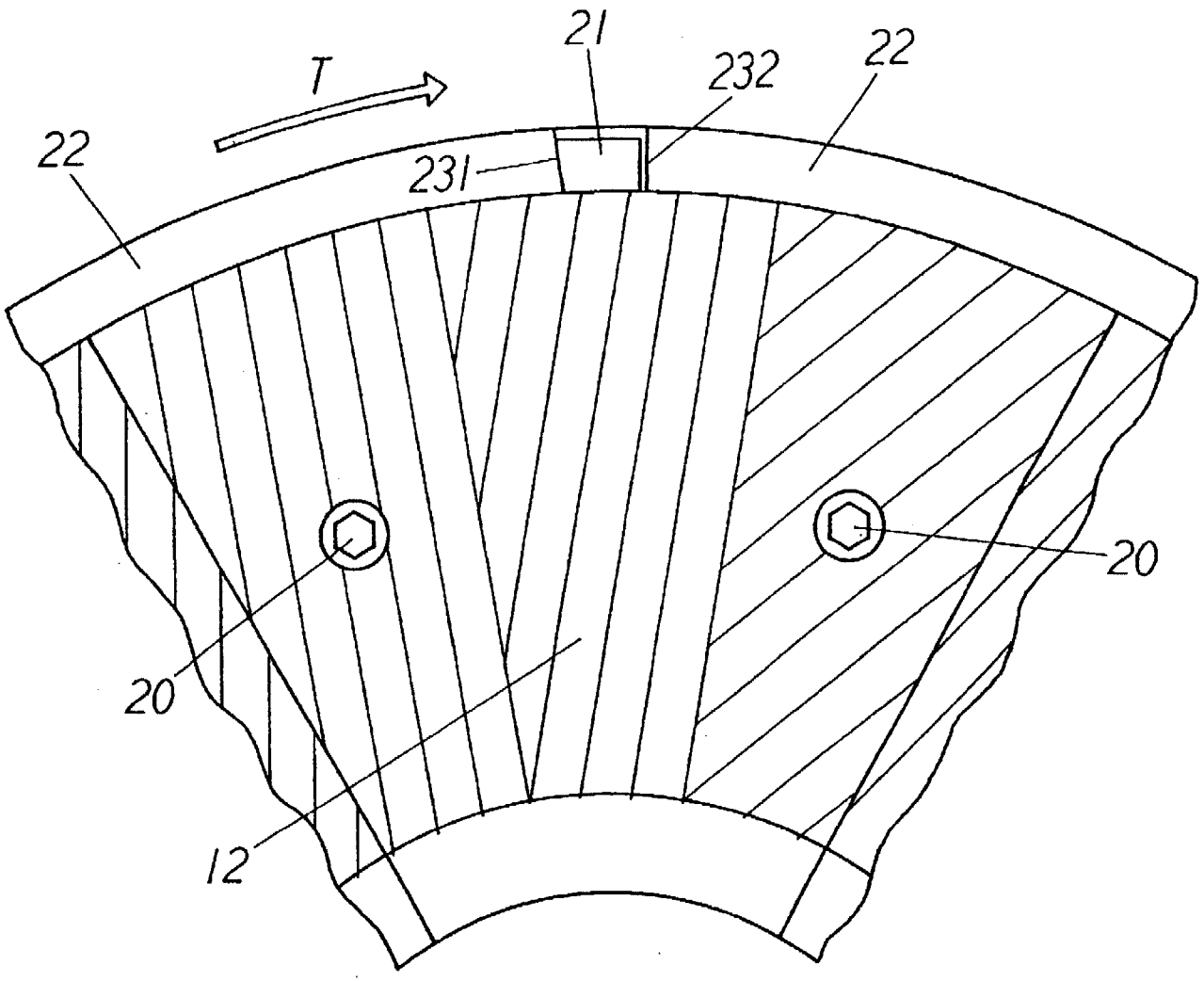
FIG. 11 is an explanatory view for explaining another embodiment relative to the embodiment as shown in FIG. 10.
Figure 12:
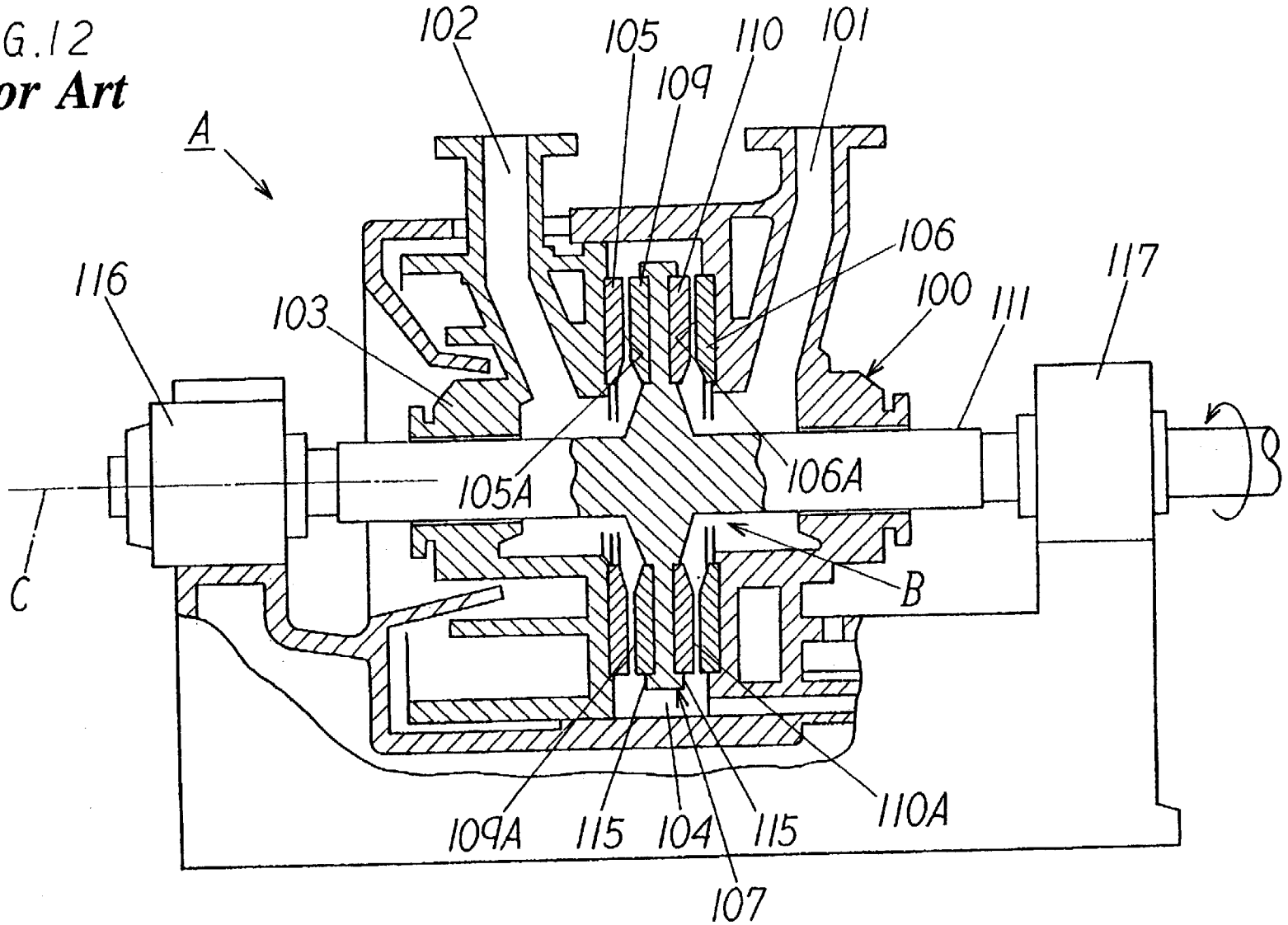
FIG. 12 Prior Art
FIG. 12 is a front sectional view for showing a conventional refiner.
Figure 13:
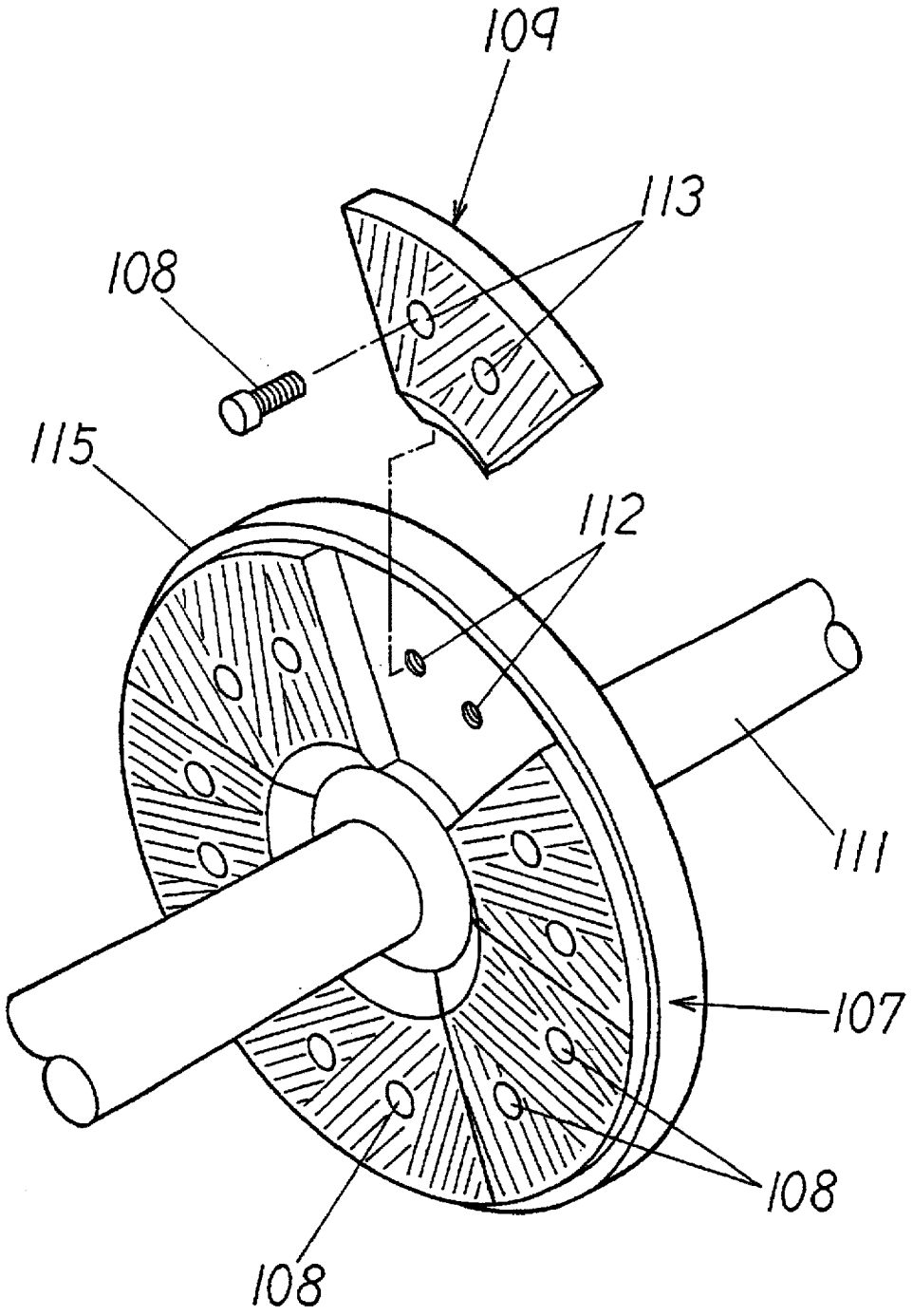
FIG. 13 Prior Art
FIG. 13 is a perspective view for showing an essential part of the conventional refiner.

Also, irrespective of the centrifugal force, as shown in FIGS. 9 to 11, the engaging members, i.e. the engaging pawls 21 projecting to the radial direction, may not contact the second vertical surfaces 232, but at least in a state where the engaging members, i.e. the engaging pawls 21 projecting in the radial direction, are in surface contact with the first vertical surfaces 231, the discs, i.e. the second disc members 12, 13, are attached to the circular plate-shape runner 11 by the connecting members, i.e. bolts 20. Therefore, a force is positively applied to the engaging members, i.e. the engaging pawls 21 projecting in the radial direction, to thereby reduce a force applied to the connecting members, i.e. the bolts 20.

Incidentally, in the above embodiment, although the first or the second discs are formed of a plurality of the disc members, the present invention is not limited to the embodiment. In the present invention, the first or second disc may be formed of a single structure, and attached to the runner or the casing through connecting members to obtain the same effect.

As described above, according to the first aspect of the invention, at the time of rotation of the rotating shaft, loads of the first disc members or the second disc members applied to the first connecting members or the second connecting members can be reduced as much as possible.

Therefore, the number of the first connecting members or the second connecting members for the first disc members or the second disc members may be reduced, or the first connecting members or the second connecting members may be made thin. As a result, the effective areas of the blade faces can be increased as much as possible to thereby improve crushing or grinding efficiency of the materials.

Also, when the first and the second disc members are changed, the tightening and loosening operations of the first connecting members and the second connecting members can be reduced. Therefore, the attaching and detaching operations of the first disc members or the second disc members can be simplified.

According to the second aspect of the invention, in addition to the effects of the first aspect, since the engaging members are disposed on the circular arc faces of the outer sides of the first disc members or the second disc members, at the time of attachment of the first disc members or the second disc members, the engaging members can be visually identified. Therefore, positioning operations of the first disc members or the second disc members can be quickly carried out.

According to the third aspect of the invention, at the rotation of the rotating shaft, loads of the first disc members or the second disc members applied to the first connecting members or the second connecting members can be reduced as much as possible.

Therefore, the number of the first connecting members or the second connecting members for the first disc members or the respective second disc members can be reduced, or the first connecting members or the second connecting members can be made thin. Therefore, the effective areas of the blade faces can be broadened as much as possible to thereby improve the crushing or grinding efficiency of the materials.

Also, when the first or second disc members are replaced, tightening and loosening operations of the first connecting members or the second connecting members can be reduced. Therefore, attaching and detaching operations of the first disc members or the second disc members can be simplified.

According to the fourth aspect of the invention, in case loads are applied to the discs by rotation of the circular plate-shape runner, since the engaging members are, at least, in contact with the first vertical surfaces, the forces are positively applied to the engaging members to thereby reduce the forces acted on the connecting members.

According to the fifth aspect of the invention, in case loads are applied to the discs by rotation of the circular plate-shape runner, since the engaging members are in contact with the first vertical surfaces, forces are positively acted on the engaging members.

Although a centrifugal force acts on the disc members with rotation of the runner, if the edges of the engaging members abut against the second vertical surfaces, the force is dispersed by the abutment to thereby reduce the force applied to the connecting members.

What is claimed is:

1. A refiner comprising, a circular plate-shape runner having an outer periphery and two side faces;

a rotating shaft fixed to a center of the runner to extend perpendicularly thereto;

at least one annular rib projecting from said outer periphery of the runner in an axial direction of said rotating shaft to form a disc receiving dent portion at one of the side faces of the runner, said annular rib having a side surface, and inner and outer circumferential surfaces;

a plurality of discs having blades on side faces and outer peripheries, said discs being disposed in the disc receiving dent portion in the runner;

a plurality of engaging members provided on said outer peripheries of said discs to extend outwardly therefrom; and a plurality of dent portions for receiving and engaging said engaging members provided in said at least one annular rib, each dent portion extending from the side surface along the axial direction of said rotating shaft and having a bottom surface extending along the side surface of the rib, a first surface and a second surface, said first and second surfaces facing each other and extending from said bottom surface to cross said inner and outer circumferential surfaces of the rib, said first surface facing a rotating direction of said circular plate-shape runner, said second surface facing a direction opposite to said rotating direction of said runner, said discs being fixed and supported onto said runner such that said engaging members contact said first surfaces of the dent portions.

2. A refiner according to claim 1, wherein said second surface is inclined such that a space between the first and second surfaces is narrower on a far side than on a near side from a center of said runner, said discs being attached to said runner in a state where edges of said engaging members abut against said second surfaces.

3. A refiner according to claim 2, wherein said discs are divided along a circumferential direction.

4. A refiner according to claim 1, wherein each of said discs has one engaging member on the outer periphery thereof, each engaging member being a projection having a surface engaging the first surface of each dent portion so that when the runner is rotated around the rotating shaft, rotation of the discs is prevented.

5. A refiner according to claim 4, wherein each projection has a rectangular shape, and each dent has a rectangular shape to immovably retain each projection therein.

6. A refiner according to claim 5, further comprising connecting members for connecting the discs to the runner.

7. A refiner according to claim 1, wherein said runner has the discs on both side faces symmetrically to each other.

8. A refiner according to claim 7, further comprising a casing for rotationally receiving the runner with the discs therein, and second discs attached to the casing to face the discs formed on the runner.

* * * * *